United States Patent [19]

Smith

[11] Patent Number: 4,534,444

[45] Date of Patent: Aug. 13, 1985

[54] INSULATED BOOM STRUCTURE FOR TELESCOPING AERIAL LIFT

[75] Inventor: Van Z. Smith, Waco, Tex.

[73] Assignee: Time Manufacturing Company, Waco, Tex.

[21] Appl. No.: 642,158

[22] Filed: Aug. 20, 1984

Related U.S. Application Data

[63] Continuation of Ser. No. 526,978, Aug. 29, 1983, abandoned.

[51] Int. Cl.[3] ..... B66F 11/04

[52] U.S. Cl. ..... 182/2; 182/46

[58] Field of Search ..... 182/2, 46; 52/118; 414/727, 722; 212/269, 267

[56] References Cited

U.S. PATENT DOCUMENTS

| | | | |
|---|---|---|---|
| 3,043,394 | 7/1962 | Hall | 182/2 |
| 3,136,385 | 6/1964 | Eitel | 182/2 |
| 3,139,948 | 7/1964 | Rorden | 182/2 |
| 3,947,191 | 3/1976 | Milner | 182/2 |
| 4,385,704 | 5/1983 | Spain | 52/118 |
| 4,434,902 | 3/1984 | Goode | 52/118 |

*Primary Examiner*—Reinaldo P. Machado

*Attorney, Agent, or Firm*—Wm. T. Wofford; James C. Fails; Arthur F. Zobal

[57] ABSTRACT

The invention provides improved telescopic boom structure for aerial lifts, including the provision of a lower boom structure outer end portion made of electrical insulating material, which together with other provisions, accomplishes the essential elimination of electric shock hazard to personnel without incurring any of the disadvantages of significantly increased expense, reduced effective working area due to reduced range of boom extension, or increased stowed length of the boom structure.

6 Claims, 2 Drawing Figures

INSULATED BOOM STRUCTURE FOR TELESCOPING AERIAL LIFT

This application is a continuation, of application Ser. No. 60/526,978, filed 08-29-83 and now abandoned.

FIELD OF THE INVENTION

This invention concerns improved insulated boom structure for telescoping aerial lifts.

DESCRIPTION OF THE PRIOR ART

Aerial lifts of the type in which a personnel carrier bucket is mounted at the outer end of a telescoping boom are commonly used for work in areas where electric power lines are present, with the result that personnel may be exposed to the hazard of an electric shock that could occur due to the completion of an electric circuit through the body of a person occupying the bucket and via the telescoping boom mechanism to ground. This problem has been addressed in the prior art of which I am aware by making the upper or outermost section of the boom, to which the bucket is mounted, of insulating material such as fiber glass. This arrangement, however, does not provide adequate shock protection because the next outermost or lower boom section is metal and the upper boom section can be retracted to positions near enough to the next outermost or lower boom section to be reached by a person occupying the bucket and furthermore, safe leakage current levels can be exceeded in the presence of high voltage.

It has been suggested that the inward travel of the upper boom section could be limited by a stop means such that safe leakage current levels would not be exceeded in the presence of high voltage and a person occupying the bucket could never reach the metal lower boom section. If this is done, however, the range of the boom extension is accordingly limited and the effective working area is reduced, and also the stowed length of the boom structure is increased.

The objective to this invention is to provide an improved telescopic boom structure for aerial lifts such that the electric shock hazard to personnel is essentially eliminated without incurring any of the disadvantages of significantly increased expense, reduced effective working area due to reduced range of boom extension, or increased stowed length of the boom structure.

DESCRIPTION OF THE PREFERRED EMBODIMENT

Figure 1:
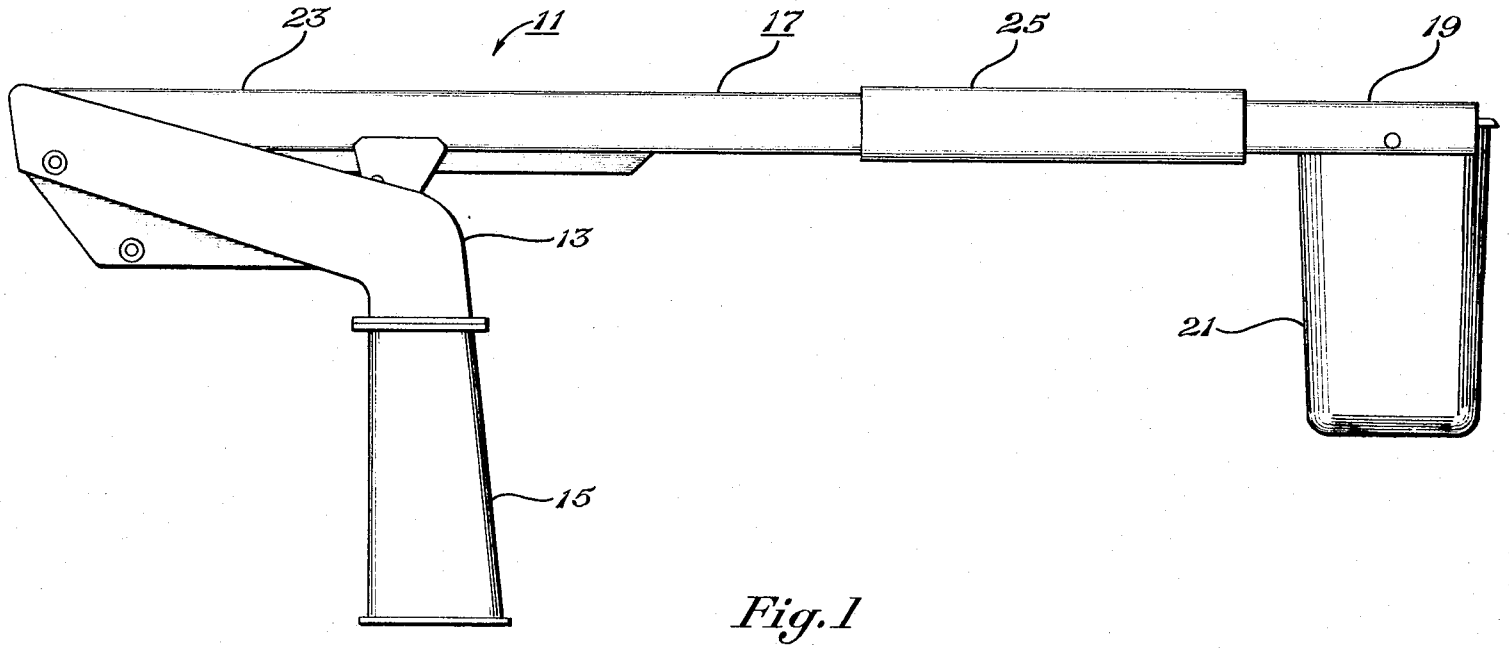
FIG. 1 is a schematic elevational view showing an aerial lift which incorporates an improved boom structure in accordance with a preferred embodiment of the invention.

In FIG. 1 there is shown an aerial lift which incorporates improved telescoping boom structure 11 in accordance with a preferred embodiment of the invention. The improved telescoping boom structure 11 is mounted in a conventional manner to a support arm structure 13 for pivoting movement in a generally vertical plane so as to provide elevational movement for the telescoping boom structure 11. Conventional means (not shown) are provided to power and control the elevational movement of the telescoping boom structure 11. The support arm structure 13 is mounted for rotational movement in a conventional manner on a pedestal structure 15 which in turn is adapted for mounting on a transport vehicle (not shown). The support arm structure 13 is powered and controlled by conventional means (not shown) so as to provide swinging movement for the telescoping boom structure 11.

The telescoping boom structure 11 is made up of a lower boom section 17 and an upper boom section 19. The upper boom section is adapted for mounting a personnel carrier bucket 21 in a conventional manner.

Figure 2:
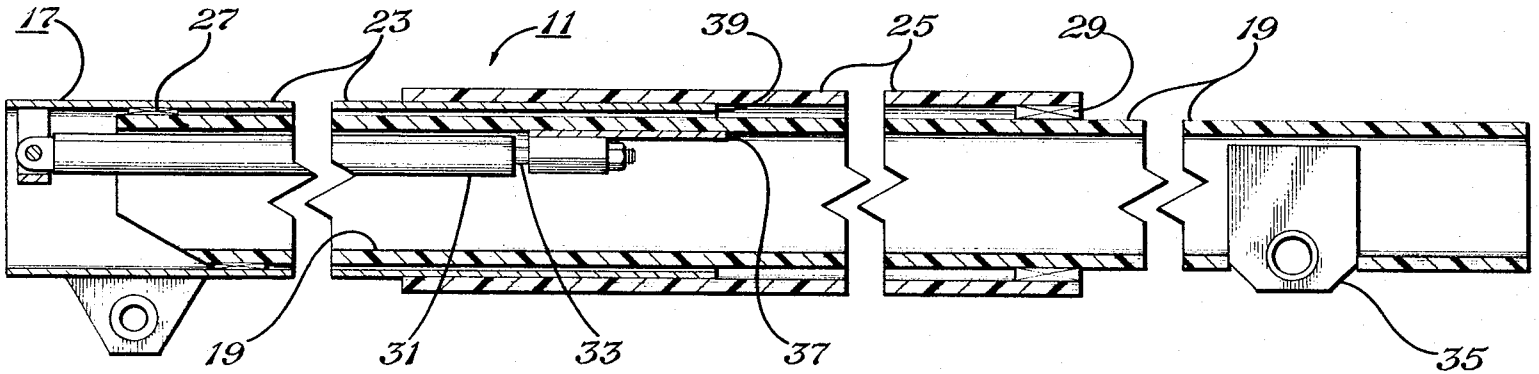
FIG. 2 is a schematic elevational view, enlarged and partly in section, of the boom structure of the aerial lift of FIG. 1.

As can best be seen in FIG. 2, the lower boom section 17 is made up of a main portion 23 which is made of metal and an outer end portion 25 which is made of an electric insulating material, preferably fiber glass. The entire length of the upper boom section 19 is made of an electric insulating material, preferably fiber glass. The upper boom section 19 is mounted for extending and retracting movement within the lower boom section 17 and is supported within the lower boom section 17 by conventional bearing means 27, 29. Conventional means, shown as a hydraulic cylinder 31 with a reciprocable output rod 33, is provided to power the upper boom section 19 for extending and retracting movement. Shown schematically at the outer end portion of the upper boom section 19 is a portion of conventional means 35 for mounting the personnel carrier bucket 21.

The means 31, 33 for powering the upper boom section is generally electrically conductive, and has an electrically conductive upper extremity 37 which, when the upper boom structure is fully retracted, is near the upper extremity 39 of the electrically conductive lower boom structure main portion 23. The lower boom structure outer end portion 25, which is made of electric insulating material, when the upper boom structure is fully retracted, extends beyond the electrically conductive upper extremities 37, 39 for a distance that is sufficient to insure that a person occupying the bucket could not reach the metal portion of the lower boom section and that safe leakage current levels will not be exceeded in the presence of high voltage. The effect of providing a lower boom structure outer end portion 25 made of insulating material is to move the upper extremity 39 of the metal portion of the lower boom structure inward, permitting the insulating outer end portion to be a structural substitute for the length of the metal portion that was moved inward. Tests have shown that this distance should be at least 36 inches, and it has been found in practice that 42 inches is a desirable distance.

It should be apparent in view of the foregoing that the invention provides improved telescopic boom structure for aerial lifts such that the electric shock hazard to personnel is essentially eliminated without incurring any of the disadvantages of significantly increased expense, reduced effective working area due to reduced range of boom extension, or increased stowed length of the boom structure.

The foregoing disclosure and the showings made in the drawings are merely illustrative of the principles of this invention and are not to be interpreted in a limiting sense.

I claim:

1. Improved telescoping boom structure for an aerial lift of the personnel carrying type comprising:

a. a lower boom section, b. an upper boom section supported by said lower boom section for telescoping movement within said lower boom section, with said upper boom section being made of an electric insulating material and adapted for mounting a personnel carrier bucket at its outer end portion;

c. means for powering said upper boom for extending and retracting movement;

d. said lower boom section having a main portion made of metal and having an electrically conductive upper extremity and an outer end portion made of electric insulating material, with said outer end portion, when said upper boom section is fully retracted, extending beyond said electrically conductive upper extremity for a distance sufficient to insure that a person occupying the bucket could not reach the metal portion of the lower boom section and that safe leakage current levels will not be exceeded in the presence of high voltage.

2. The device of claim 1 wherein said electric insulating material is fiber glass.

3. The device of claim 1 wherein said distance is at least 36 inches.

4. The device of claim 2 wherein said distance is at least 36 inches.

5. The device of claim 1 wherein said distance is at least 42 inches.

6. The device of claim 2 wherein said distance is at least 42 inches.

* * * * *